US010294670B1

(12) United States Patent
Green et al.

(10) Patent No.: US 10,294,670 B1
(45) Date of Patent: May 21, 2019

(54) ARCHITECTURAL SCREEN ROOF CURBS

(71) Applicant: MGM PRODUCTS, INC., Conyers, GA (US)

(72) Inventors: Dotson Carson Green, Conyers, GA (US); Adnan Bijelic, Loganville, GA (US)

(73) Assignee: MGM PRODUCTS, INC., Conyers, GA (US)

( * ) Notice: Subject to any disclaimer, the term of this patent is extended or adjusted under 35 U.S.C. 154(b) by 0 days.

(21) Appl. No.: 15/348,925

(22) Filed: Nov. 10, 2016

Related U.S. Application Data

(60) Provisional application No. 62/254,133, filed on Nov. 11, 2015.

(51) Int. Cl.
*E04D 13/00* (2006.01)

(52) U.S. Cl.
CPC ..... *E04D 13/00* (2013.01)

(58) Field of Classification Search
CPC ..... E04D 13/00
USPC ..... 52/60, 200, 282.2, 58, 285.3, 285.4, 52/587.1
See application file for complete search history.

(56) References Cited

U.S. PATENT DOCUMENTS 3,611,661 A * 10/1971 Chambers et al. ... E04D 13/158 52/262
4,151,694 A * 5/1979 Sriberg ..... E04B 5/29 403/347
4,488,791 A * 12/1984 Hinchliffe ..... E04D 13/031 134/34
4,917,345 A * 4/1990 Czech ..... F24F 13/32 248/237
5,099,622 A * 3/1992 Sutton ..... E04B 9/32 52/200
5,216,855 A * 6/1993 Richter ..... E04D 13/0305 49/DIG. 2
5,454,538 A * 10/1995 Merideth ..... F24F 13/32 248/148
5,647,175 A * 7/1997 Smyth ..... E04D 13/0315 52/1
5,687,514 A * 11/1997 Gillispie ..... E04D 13/0315 52/200
5,715,636 A * 2/1998 Taylor ..... E04B 5/46 428/428
5,791,092 A * 8/1998 Strieter ..... E04D 13/031 248/237
5,832,674 A * 11/1998 Ledbetter ..... E04D 13/0315 181/224
5,896,711 A * 4/1999 McClure ..... E04D 13/0315 52/198
6,016,877 A * 1/2000 Noonan ..... B23K 33/00 172/776

(Continued)

*Primary Examiner* — Joshua K Ihezie
(74) *Attorney, Agent, or Firm* — Michael J. Bootheck, LLC; Michael J. Bootcheck

(57) ABSTRACT

An architectural screen roof curb supported by an upstanding support curb to camouflage or hide various articles including, but not limited to, HVAC units. The architectural screen roof curb includes a top curb portion and two or more spaced, generally horizontal extending support members which then, in turn, support one or more architectural screens such that no portion of the architectural screen roof curb comes into contact with the underlying roof.

7 Claims, 2 Drawing Sheets

(56) References Cited

U.S. PATENT DOCUMENTS

| | | | | |
|---|---|---|---|---|
| 6,041,557 | A * | 3/2000 | Brown | E04D 13/0315 52/200 |
| 6,195,948 | B1 * | 3/2001 | Lamanna | E04D 13/0305 52/200 |
| 6,862,854 | B1 * | 3/2005 | Fitzmyers | E04B 5/14 248/499 |
| 7,065,928 | B1 * | 6/2006 | Lane | F24F 13/32 52/200 |
| 7,752,823 | B2 * | 7/2010 | Robinson | E04C 3/02 52/317 |
| 8,448,393 | B2 * | 5/2013 | Voegele, Jr. | E04D 13/0315 52/200 |
| 8,528,875 | B2 * | 9/2013 | Wilson, Jr. | F24F 1/60 248/188.1 |
| 8,745,938 | B2 * | 6/2014 | Schuetz | E04D 13/033 52/200 |
| 8,960,620 | B1 * | 2/2015 | Merideth | F24F 13/32 248/148 |
| 9,217,581 | B1 * | 12/2015 | Merideth | F24F 13/32 |
| 2003/0182873 | A1 * | 10/2003 | Clasen | F24F 13/32 52/73 |
| 2006/0272232 | A1 * | 12/2006 | Fooks | E04D 13/0305 52/200 |
| 2009/0019789 | A1 * | 1/2009 | Gephart | E04D 13/00 52/73 |

* cited by examiner

ARCHITECTURAL SCREEN ROOF CURBS

CROSS-REFERENCE TO RELATED APPLICATIONS

This application claims priority from U.S. Provisional Application Ser. No. 62/254,133 filed 11 Nov. 2015, which is titled "LOUVERED SCREEN ROOF CURBS", which is hereby incorporated in its entirety by reference.

FIELD OF THE INVENTION

The present invention is for devices which hold and maintain architectural screen roof curbs. For example, they may be used to camouflage or hide HVAC units and other apparatus.

BACKGROUND OF THE INVENTION

In many commercial, industrial and other buildings, air conditioning units and other mechanical equipment are often located on the roof of the building above an opening. Such equipment is commonly mounted on upstanding roof curbs which are in register with the roof and provide the support for the equipment while allowing ductwork, wiring and other materials to pass through an opening in the roof curb and the roof. The roof curb provides a base for the mounting of HVAC and other equipment.

It is often desired to camouflage, obfuscate or otherwise mask the air conditioners or other equipment and structures, which would otherwise be in plain view. Such screening may be for aesthetic purposes to provide the building with a more pleasing appearance or it may provide a functional benefit such as sound dampening, filtration, or other means.

Typically such screening would be mounted directly to the roof or the HVAC equipment. Each of these methods present very significant problems though, including additional costs for labor and material, additional roof penetrations, and potential damage to the roof and/or the equipment both during the installation process and during the functioning of the screening.

What is needed is a device which is able to provide suitable screening for aesthetics or other purposes but which does not require any additional roof penetration and does not need to be mounted to the equipment.

SUMMARY OF THE INVENTION

The present is an architectural screen roof curb device mounted on an upstanding support curb, the upstanding support curb presenting two sets of perpendicular parallel spaced walls, the device comprising a top curb placed on top of, and in contact with and supported wholly by, the support curb, two or more spaced, generally horizontally extending support members which extend outwardly, and are supported by, the top curb, and the two or more spaced support members are not in direct contact with the support curb, one or more architectural screens are spaced outwardly from the top curb and supported by, and attached to, at least one of the two or more support members, and the one or more architectural screens are for concealing the equipment from view, and the support curb comprises the sole support for the top curb, whereby the one or more architectural screens are secured to the top curb without attachment to the underlying roof or the equipment thereon, and wherein a portion of the two or more support members is located interior to the top curb.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains. In the figures, like reference numbers represent the same component.

Figure 1:
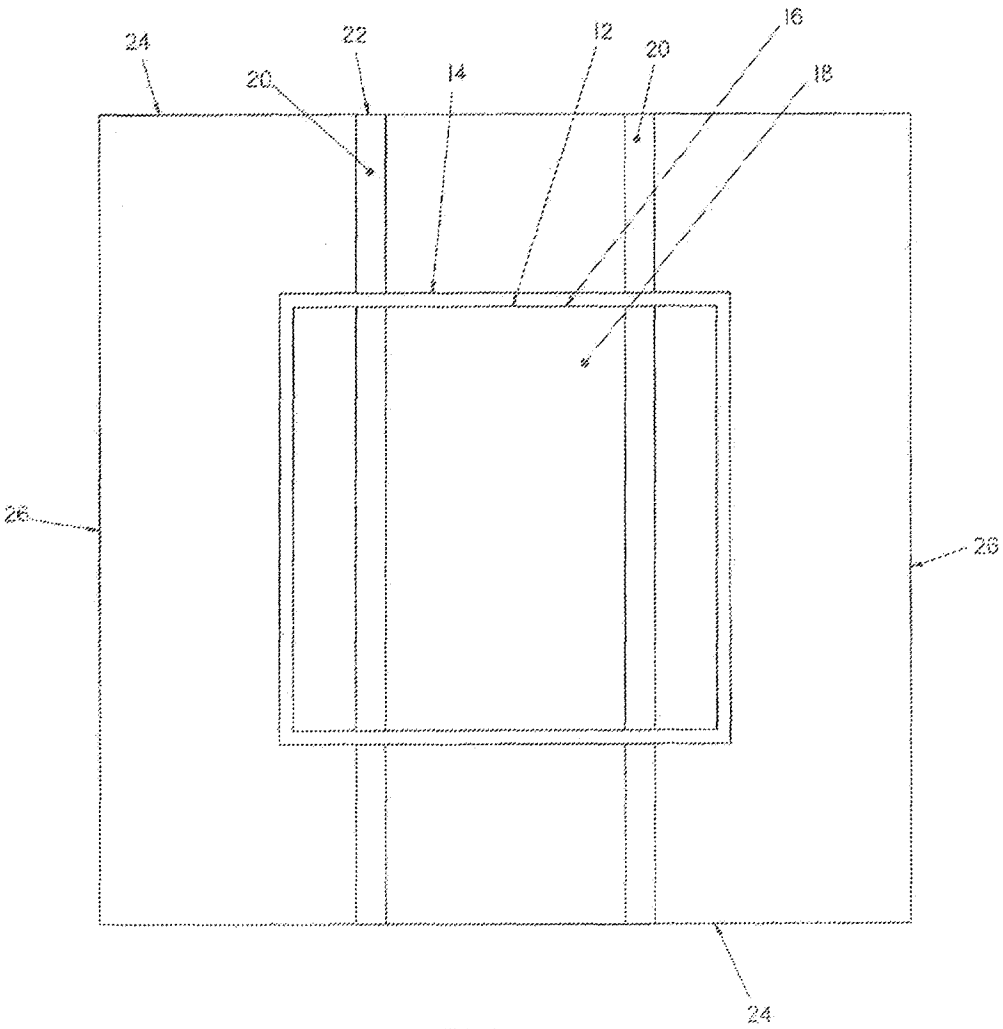
FIG. 1 is a top view of an exemplary embodiment of the present invention.
Figure 2:
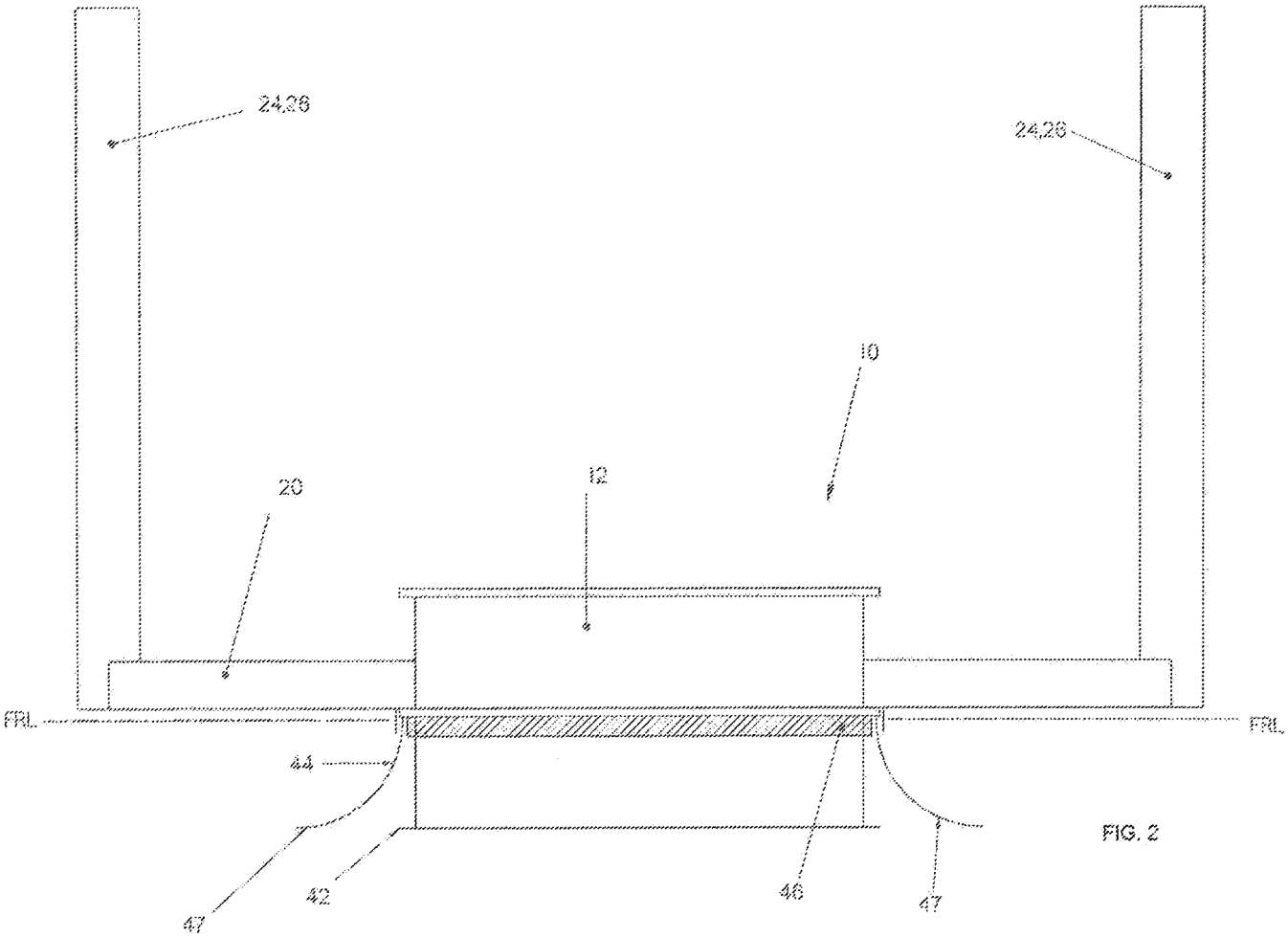
FIG. 2 is a side view of the embodiment of FIG. 1.

FIG. 1 is a top view of an exemplary embodiment of the present invention illustrating an architectural screen roof curb device 10 mounted on an upstanding support curb (see FIG. 2). Screening according to the present invention includes any suitable screening including, but not limited to, architectural screening, signage, louvered screening, sound dampening, filtration, etc. For simplicity, such screening will be referred to herein as "architectural screening" although it is to be understood that such screening may provide various benefits. Illustrated for this exemplary screen roof curb device 10 (which is supported by upstanding support curb 40 of FIG. 2) are top curb 12, top curb outer surface 14, top curb inner surface 16 (wherein surfaces 14, 16, define sidewalls of the curb), cavity 18, support members 20, support member/screen junction/connector 22, and screens 24, 26 (architectural or other).

FIG. 2 illustrates a side view of the exemplary embodiment of FIG. 1. Illustrated is screen roof curb device 10 situated above upstanding support curb 40, which is registered with roof 42. Gap 44 allows for placement of roofing materials without those materials being impacted/contacted by any of: upstanding support curb 40, top curb 12, support members 20, or screens 24, 26. Such a configuration allows top curb 12 (and other members) to be located such as to allow space for the termination of the chosen roof material (asphalt, shingles, epdm, etc.) and does not interfere with or come into contact with those roof materials at all in either installation or during operation. This also allows for roof maintenance without need to relocate any of the components of the present invention. Also illustrated is nailer 46.

In this embodiment, top curb 12 may be placed on top of, and in contact with and supported wholly by, support curb 40. Support members 20 may be positioned as desired to extend generally horizontally from the curb. The support members are held in place (and supported by) the curb. In this embodiment, there are two (or more) support members in order to hold and maintain the screen(s). Any suitable number of supports and screens may be incorporated into a particular embodiment. In some embodiments, the support members may extend all of the way through the cavity of the top curb (such as illustrated in the embodiment of FIG. 1), whereas in other embodiments, the support member may extend only to the inner surface of the top curb. In yet other embodiments, the support members may extend only to an outer surface of the curb to which it is attached/connected.

Also illustrated in FIG. 2 is roofing line 47 which ends at an upper level of finished roof line FRL. FRL is the highest elevation of the finished roof line, i.e., the roofing materials. In many installations, when the roof must be redone, i.e., resurfaced, etc. the workers need access to at least this elevation. Therefore, if there are obstructions below this level, they can be an impediment to such activities.

In some embodiments, i.e., particularly with both a support curb and a top curb, the support members may be completely supported by the top curb such that the support members are not in direct contact with the support curb.

The screens of the various embodiments may be of any suitable dimension, configuration, material, etc. In the embodiment of FIGS. 1 and 2, the screens are secured to the top curb without attachment to the underlying roof, the equipment thereon, or the support curb.

As illustrated, the screens may be cantilevered from the top curb without need of additional supports (beyond the one or more support members). In another embodiment, the features of the top curb may be incorporated into the support curb (or even unitary therewith).

Note that while many upstanding support curbs may present a rectangular upper surface, other geometries may also be utilized with various embodiments of the present invention and other geometric changes may be incorporated into a particular embodiment. The support curb may have a predetermined shape and a predetermined top surface geometry, and the top curb has a predetermined bottom geometry which mates with the top surface geometry. Such mating allows for a good fit, made airtight through seals (or other means). Additionally, there may be ducting, wiring, etc. which may be located in the cavity of the top curb (and also support curb) for the HVAC or other equipment/needs.

Various members of the present invention may be comprised partially, or wholly, of any suitable material including, but not limited to, steel, structural steel, rolled steel, sheet steel, plastic, rubber and aluminum.

Although various components of the present invention may be illustrated as being of a particular shape for convenience, such components may be of any suitable shape, configuration, orientation, etc.. Various components of the disclosed embodiments may be attached to each other, or to other members, by any suitable means including, but not limited to, welding, bolting, and bonding.

While the specification has been described in detail with respect to specific embodiments thereof, it will be appreciated that those skilled in the art, upon attaining an understanding of the foregoing, may readily conceive of alterations to, variations of, and equivalents to these embodiments.

What is claimed is:

1. A top roof curb device mounted on an upstanding support curb, said upstanding support curb presenting two sets of perpendicular parallel spaced walls, said device comprising:

a top curb placed on top of, and in contact with and supported wholly by, said support curb, two or more spaced, generally horizontally extending support members which extend outwardly, and are supported by, said top curb, and said two or more spaced support members are not in direct contact with said support curb, one or more architectural screens are spaced outwardly from said top curb and supported by, and attached to, at least one of said two or more support members, and said one or more architectural screens are for concealing equipment from view, and said support curb comprises the sole support for said top curb, whereby said one or more architectural screens are secured to said top curb without attachment to an underlying roof or the equipment thereon, and wherein a portion of said two or more support members is located interior to said top curb and at least one of said one or more spaced, generally extending support members has a first end exterior to said top curb and a distal end which is also exterior to said top curb, and said distal end is on an opposite side of said top curb such that a portion of said support member extends through said top curb.

2. The top roof curb device of claim 1, wherein said support curb has a predetermined shape and a predetermined top surface geometry, and said top curb has a bottom geometry which mates with said top surface geometry.

3. The top roof curb device of claim 1, wherein each of said support members extends orthogonally from at least one side wall of said top curb.

4. The top roof curb device of claim 1, wherein said architectural screens are cantilevered by said top curb.

5. The top roof curb device of claim 1, wherein each of said top roof curb, and support members are located above a supporting buildings finished roof line.

6. The top roof curb device of claim 1, wherein said support members are completely above an uppermost surface of the support curb.

7. The top roof curb device of claim 1, wherein said top roof curb has two sets of perpendicular parallel spaced walls and said support members are at least partially between said top roof curb's said two sets of perpendicular parallel spaced walls.

* * * * *